United States Patent [19]

Hardy et al.

[11] Patent Number: 4,787,874

[45] Date of Patent: Nov. 29, 1988

[54] TOY HAVING THE APPEARANCE OF A BOAT

[76] Inventors: John C. Hardy; Roberta M. Hardy, both of 25, Pottery Road, Parkstone, Poole, Dorset BH14 8RA, England

[21] Appl. No.: 17,521

[22] Filed: Feb. 24, 1987

[30] Foreign Application Priority Data

Feb. 24, 1986 [GB] United Kingdom ..... 8604489

[51] Int. Cl.[4] ..... A63H 23/02

[52] U.S. Cl. ..... 446/160; 446/76; 206/457

[58] Field of Search ..... 446/71, 75, 76, 153, 446/160, 161, 162, 163, 164, 165; 206/216, 457, 235

[56] References Cited

U.S. PATENT DOCUMENTS

| | | | |
|---|---|---|---|
| 2,503,707 | 4/1950 | Braman | 446/160 X |
| 3,561,155 | 2/1971 | Tarrson | 446/160 X |
| 4,292,758 | 10/1981 | Kuna et al. | 446/163 X |

FOREIGN PATENT DOCUMENTS

| | | | |
|---|---|---|---|
| 561473 | 5/1944 | United Kingdom | 446/160 |

OTHER PUBLICATIONS

"Attack Transport", *Playthings,* vol. 56, No. 3, p. 209, Mar. 1958.

*Primary Examiner*—Mickey Yu
*Attorney, Agent, or Firm*—Lee & Smith

[57] ABSTRACT

A child's toy comprises a structure which can float on water and which has the outward appearance of a boat. To enable the child to carry the boat, a part of the structure is displaceable into a position in which it serves as a carrying handle for the toy.

4 Claims, 2 Drawing Sheets

TOY HAVING THE APPEARANCE OF A BOAT

This invention relates to a child's toy which comprises a structure, conveniently of plastics material, having the outward appearance of a boat and which is capable of floating on water. Floating toys are well known, boats in particular being a popular plaything for young children.

According to the present invention, a child's toy comprises a structure having the outward appearance of a boat and which is capable of floating on water and wherein a part of the structure is displaceable into and out of a position in which it serves as a carrying handle for the toy.

The provision of the carrying handle enables the child to carry the toy within the home or to an area outside the home, such as a park having a pond or stream on which the child can float the toy.

Conveniently the structure includes a hinged portion providing a lid for a hollow compartment within the structure.

Thus, as well as being a plaything for a child, the toy can be used to provide a small amount of storage space and the toy can be used as a type of bathroom cabinet in which the child can accommodate certain small items, such as a tube of toothpaste or a tablet of soap or the like.

In order that the invention may be more readily understood, it will now be described, by way of example only, with reference to the accompanying drawings, in which.

Figure 4:
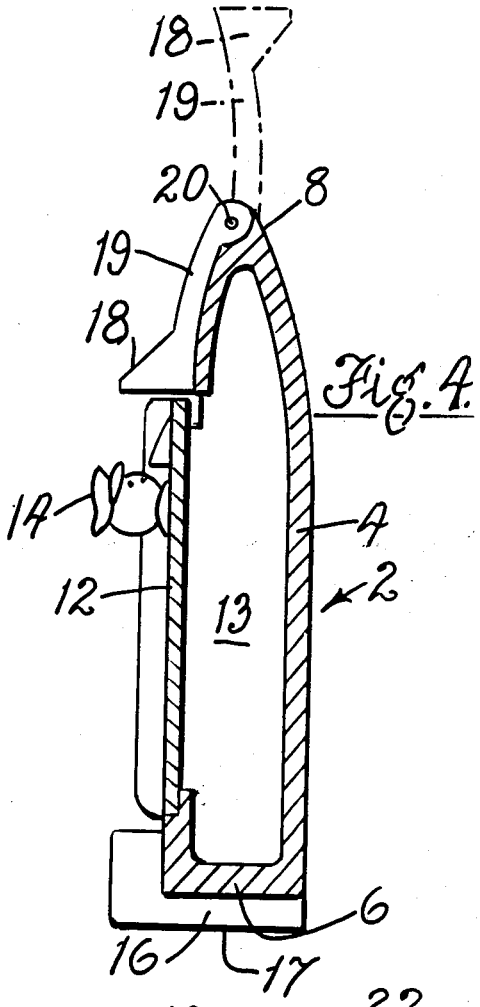
FIG. 4 is a sectional view.

The toy boat comprises a structure 2, conveniently moulded from plastics material, although it could be shaped from wood or thin sheet metal. The structure has the outward appearance of a speed boat having a generally flat bottom surface 4 and an upstanding stern 6 and shaped nose or bows 8. The structure has a lengthwise dimension which extends from the bows to the stern and which is somewhat greater than the widthwise dimension which extends from side-to-side of the boat.

Side rails 10 are provided on the structure and the flat deck 12 is located between the side rails. The deck 12 is hinged along one edge extending parallel to the lengthwise dimension of the structure and it serves as a lid for a compartment within the hull. A simple latch (not shown in detail) is provided to latch the lid in the closed position and the latch includes a moulded head and shoulders of a driver 14 of the boat. By twisting the moulded head and shoulders 14 the latch is operated. In the normal position, with the head looking forward towards the front of the boat, the deck 12 is latched in the closed position.

Figure 1:
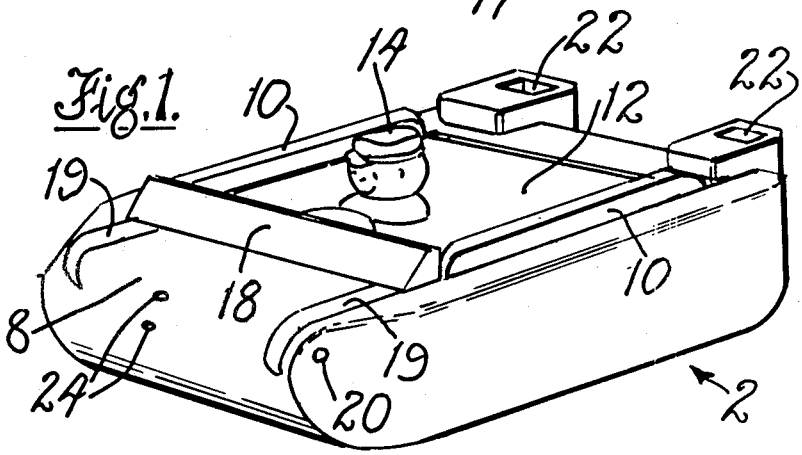
FIGS. 1 and 2 are perspective views of a toy boat.
Figure 3:
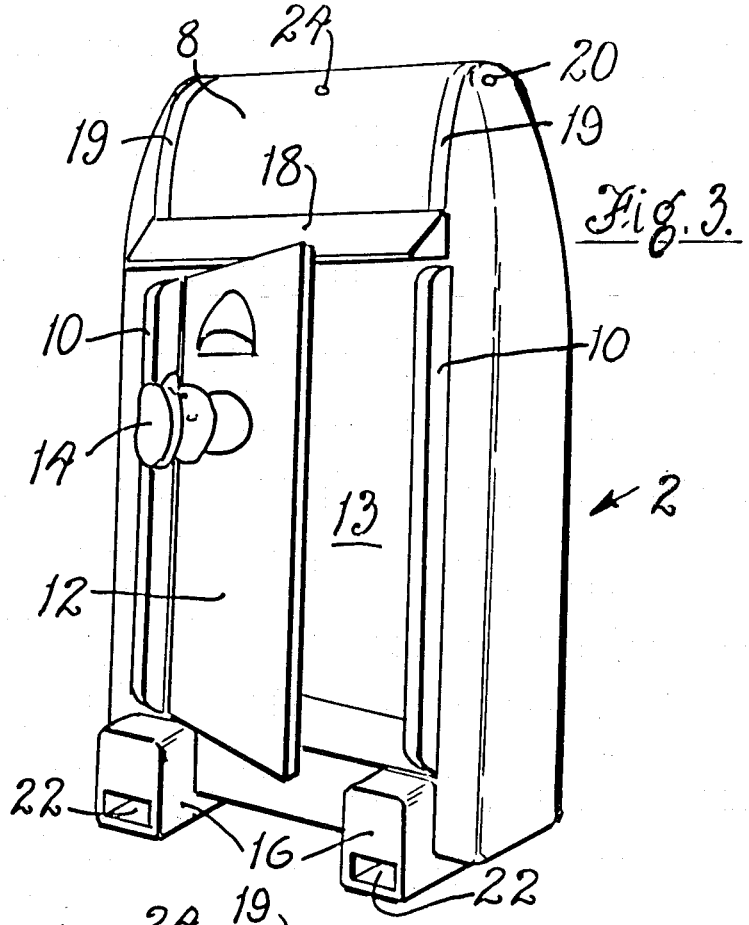
FIG. 3 shows the boat in an up-ended position.
Figure 2:
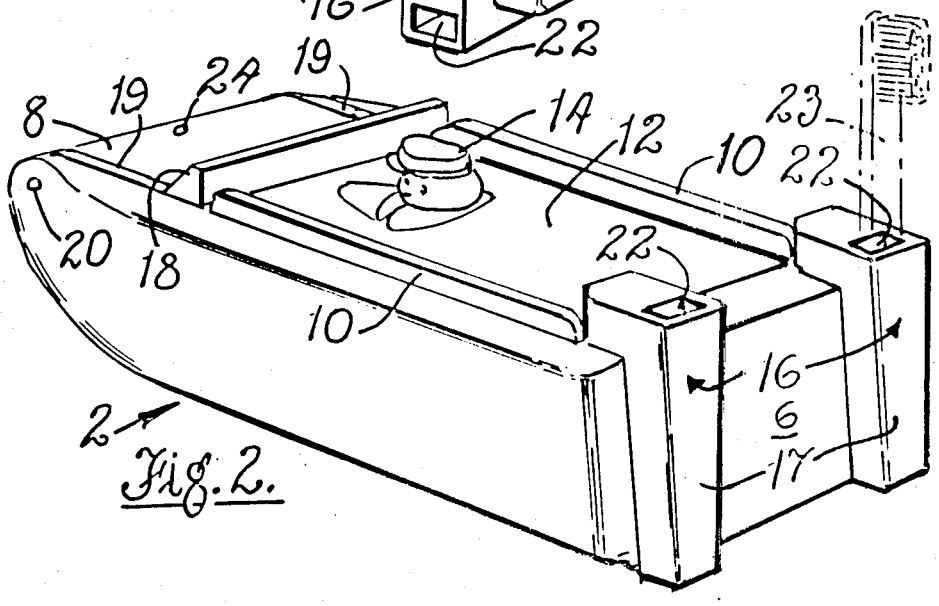

At the stern of the structure there are a pair of simulated outboard motors 16 and each motor has a generally flat surface 17 which is substantially at right angles to the bottom surface 4 of the structure so that the structure can be stably supported either on the flat bottom surface 4, as shown in FIGS. 1 and 2, or supported in the surfaces 17, as shown in FIGS. 3 and 4. When the structure is supported on the surfaces 17, the toy can serves as a small cabinet for the storage of small items, such as a tube of toothpaste, a child's toothbrush or the like. The inside of the hinged deck 12 may have a mirror attached to it so that, when the toy is acting as a storage cabinet, it may be useful to open the deck 12 to use the mirror on the inside thereof.

As an alternative, each of the simulated motors 16 has a recess 22 formed in it, the recess being of a size to accommodate the handle of a child's toothbrush when the boat is placed on its flat bottom 4. A toothbrush is shown in broken lines in FIG. 2.

A hole 24 may be formed in the front of the structure to allow a piece of string to be attached to the boat so that the boat can be towed by a child when it is floating on a stretch of water.

Although the toy may be used by the child in the bath and subsequently used as a small bathroom cabinet, the child may also wish to carry the boat away from the bathroom so as to play with it on some other stretch of water. To this end, a built in carrying handle is provided. A part of the structure is displaceable into and out of a position in which it serves as the carrying handle. In the arrangement shown, a part of the structure which extends parallel to the widthwise dimension, that is a part 18 which also represents a windscreen on the boat, is supported at its ends to a pair of arms 19 which are, in turn, pivoted to the structure about pivots 20 positioned at the forward end of the structure. The axes of the pivots extend parallel to the widthwise dimension of the structure and so the arms supporting the part 18 can pivot forward from the position shown in the drawings to the position shown in broken lines in FIG. 4 where the part 18 is forward of the front end of the structure. In this position, the child may grip the part 18 in order to readily carry the boat. When the child has carried the boat to the stretch of water where the child wishes to play with the boat, the arms and the part 18 are pivoted about the pivots 20 back to the position shown in full lines in the drawings where the part 18 represents a windscreen on the boat.

We claim:

1. A child's toy comprising a structure capable of floating on water and having the outward appearance of the hull of a boat; said structure having a bow end, a stern end, and a lengthwise dimension extending from the bow end to the stern end; said structure further having a bottom surface and a flat surface at the stream end which is substantially at right angles to the bottom surface and to the lengthwise dimension; a part of the structure at the bow end being displaceable into and out of a position where it serves as a carrying handle for the toy; and the structure including a hollow compartment and a lid for the compartment, said lid being hinged to the structure along a line extending from the bow end to the stern end of the structure.

2. A child's toy as claimed in claim 1, in which said part of the structure is pivotable into and out of the position in which it serves as a carrying handle.

3. A child's toy as claimed in claim 2, in which the structure has a widthwise dimension which extends from side-to-side of the boat and said part of the structure extends primarily parallel to the widthwise dimension.

4. A child's toy as claimed in claim 3, in which said part of the structure is of elongate form and is connected at its ends to a pair of arms which, in turn, are pivoted to said structure about axes extending parallel to the widthwise dimension of the structure.

* * * * *